US007484553B2

(12) United States Patent
Lai et al.

(10) Patent No.: US 7,484,553 B2
(45) Date of Patent: Feb. 3, 2009

(54) HEAT PIPE INCORPORATING OUTER AND INNER PIPES

(75) Inventors: Cheng-Tien Lai, Tu-Chen (TW); Tsung-Lung Lee, Tu-Chen (TW); Shenghua Wang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 1287 days.

(21) Appl. No.: 10/144,126

(22) Filed: May 10, 2002

(65) Prior Publication Data

US 2003/0183372 A1 Oct. 2, 2003

(30) Foreign Application Priority Data

Mar. 29, 2002 (TW) ..... 91204055 U

(51) Int. Cl.
*F28D 15/00* (2006.01)

(52) U.S. Cl. ..... 165/104.26

(58) Field of Classification Search ..... 165/154, 165/104.26

See application file for complete search history.

(56) References Cited

U.S. PATENT DOCUMENTS 3,528,494 A * 9/1970 Levedahl ..... 165/104.26
3,789,920 A * 2/1974 Low et al. ..... 165/104.26
3,857,441 A * 12/1974 Arcella ..... 165/104.26
5,076,352 A * 12/1991 Rosenfeld et al. ..... 165/104.26
5,076,441 A * 12/1991 Gerlier ..... 209/534

FOREIGN PATENT DOCUMENTS

JP 0106388 * 6/1983

* cited by examiner

*Primary Examiner*—Patricia Bianco
*Assistant Examiner*—Nihir Patel
(74) *Attorney, Agent, or Firm*—Wei Te Chung

(57) ABSTRACT

A heat pipe includes an outer pipe (10), an inner pipe (20), and a hermetic cap (30). The outer pipe has an evaporating end (12) and a condensing end (14). The evaporating end is integrally sealed and receives working fluid. The inner pipe includes an open top and an open bottom. A very narrow gap (40) is defined between the inner pipe and the outer pipe. A plurality of granules is put into the gap to form a porous wicking structure. When the evaporating end is heated by an external heat source, the working fluid is vaporized and flows up along the inner pipe to the condensing end. The working fluid condenses at the condensing end, and flows back down to the evaporating end through the gap. Because the gap is very narrow, surface tension of the working fluid and capillary action of the outer and inner pipes is enhanced.

18 Claims, 5 Drawing Sheets

HEAT PIPE INCORPORATING OUTER AND INNER PIPES

BACKGROUND OF THE INVENTION

1. Field of the Invention

The present invention relates to a heat pipe for a heat sink assembly, and particularly to a heat pipe which has an outer pipe incorporating an inner pipe therein.

2. Related Art

Historically, the use of metallic heat sinks has been sufficient to provide the thermal management required for most electronic cooling applications. However, with a new breed of compact electronic devices requiring dissipation of larger heat loads, the efficacy of metallic heat sinks is sometimes limited due to the weight and physical size of the heat sink required to perform the cooling. Accordingly, the use of heat pipes is becoming an increasingly popular solution of choice.

Conventional heat pipes are sealed vacuum vessels that are partly filled with working fluid. When external heat is input at an evaporating end, the working fluid is vaporized, creating a pressure gradient in the heat pipe. This pressure gradient forces the vapor to flow along the heat pipe to a cooler section (a condensing end) where it condenses and releases latent heat that was absorbed in the process of the vaporization. The condensed working fluid then returns to the evaporating end through a wicking structure that provides capillary forces. There are several types of wicking structures in common use, including grooves, screening, fibers, and sintered metal powder. An example of a conventional wicking structure is disclosed in Taiwan Patent Application No. 86206429. A plurality of fibers is formed at an inner face of the heat pipe. At least one V-shaped groove is defined in each fiber along an axial direction of the fiber. Another example of a conventional wicking structure is disclosed in Taiwan Patent Application No. 88209813. A piece of metal screening is attached to an inner face of a heat pipe. The metal screening has a plurality of through holes, and a plurality of grooves defined in a surface thereof along an axial direction of the heat pipe. However, the capillary forces provided by these conventional wicking structures are often still not sufficient. Furthermore, the vapor and the condensed fluid flow in the same pipe in opposite directions and interfere with each other. This retards the heat dissipating efficiency of the heat pipe.

Thus a heat pipe that can overcome the above-described problems is desired.

BRIEF SUMMARY OF THE INVENTION

Accordingly, an object of the present invention is to provide a heat pipe which has good heat dissipating efficiency.

Another object of the present invention is to provide a heat pipe which incorporates an outer pipe and an inner pipe.

To achieve the above-mentioned objects, a heat pipe comprises an outer pipe, an inner pipe and a hermetic cap. The outer pipe has an evaporating end and a condensing end. The evaporating end is integrally sealed and receives working fluid. The cap seals the outer pipe at the condensing end. The inner pipe comprises an open top and an open bottom. A very narrow gap is defined between the inner pipe and the outer pipe. A plurality of granules is put into the gap to form a porous wicking structure. When the evaporating end is heated by an external heat source, the working fluid is vaporized and flows up along the inner pipe to the condensing end. The working fluid condenses at the condensing end, and flows back down to the evaporating end through the gap. Because the gap is very narrow, surface tension of the working fluid and capillary action of the outer and inner pipes is enhanced.

Other objects, advantages and novel features of the present invention will be drawn from the following detailed description of preferred embodiments of the present invention with the attached drawings, in which:

DESCRIPTION OF THE PREFERRED EMBODIMENTS

Figure 1:
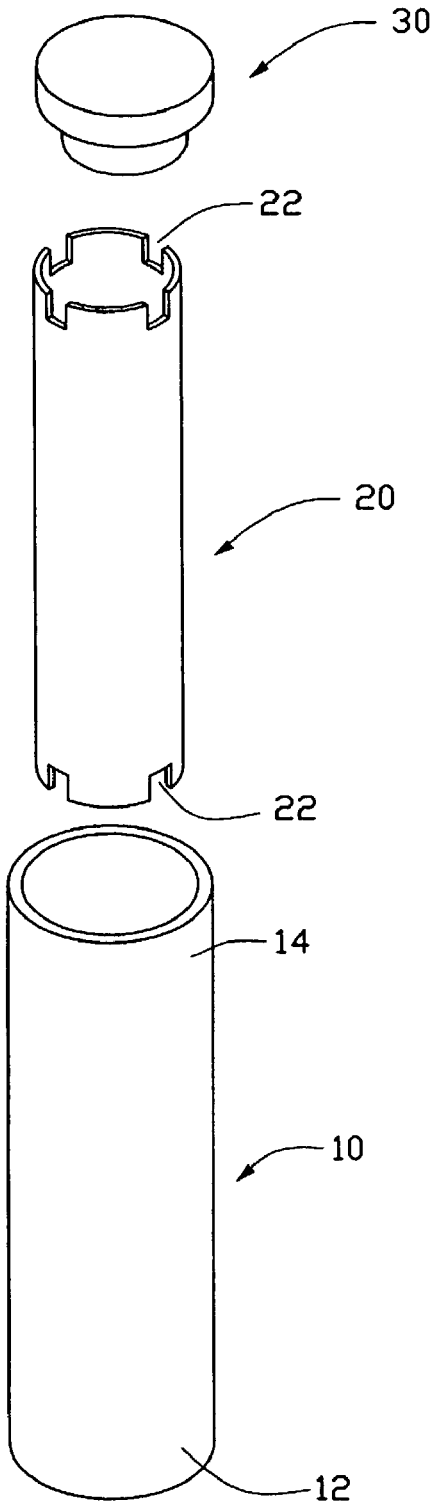
FIG. 1 is an exploded perspective view of a heat pipe in accordance with a preferred embodiment of the present invention, the heat pipe comprising an outer pipe, an inner pipe and a hermetic cap.

Referring to FIG. 1, a heat pipe in accordance with a preferred embodiment of the present invention comprises an outer pipe 10, an inner pipe 20 and a hermetic cap 30. The outer pipe 10 comprises an evaporating end 12, and an opposite condensing end 14. The evaporating end 12 comprises an integrally sealed bottom. The condensing end 14 comprises an open top to receive the hermetic cap 30. Working fluid (not shown) in liquid form is received in the evaporating end 12 of the outer pipe 10. The working fluid is adapted to readily evaporate. The inner pipe 20 comprises an open top and an open bottom. A plurality of evenly spaced cutouts 22 is defined in each of top and bottom ends of the inner pipe 20. The inner pipe 20 has a height approximately equal to a height of the outer pipe 10, and has an outer diameter slightly less than an inner diameter of the outer pipe 10.

Figure 2:
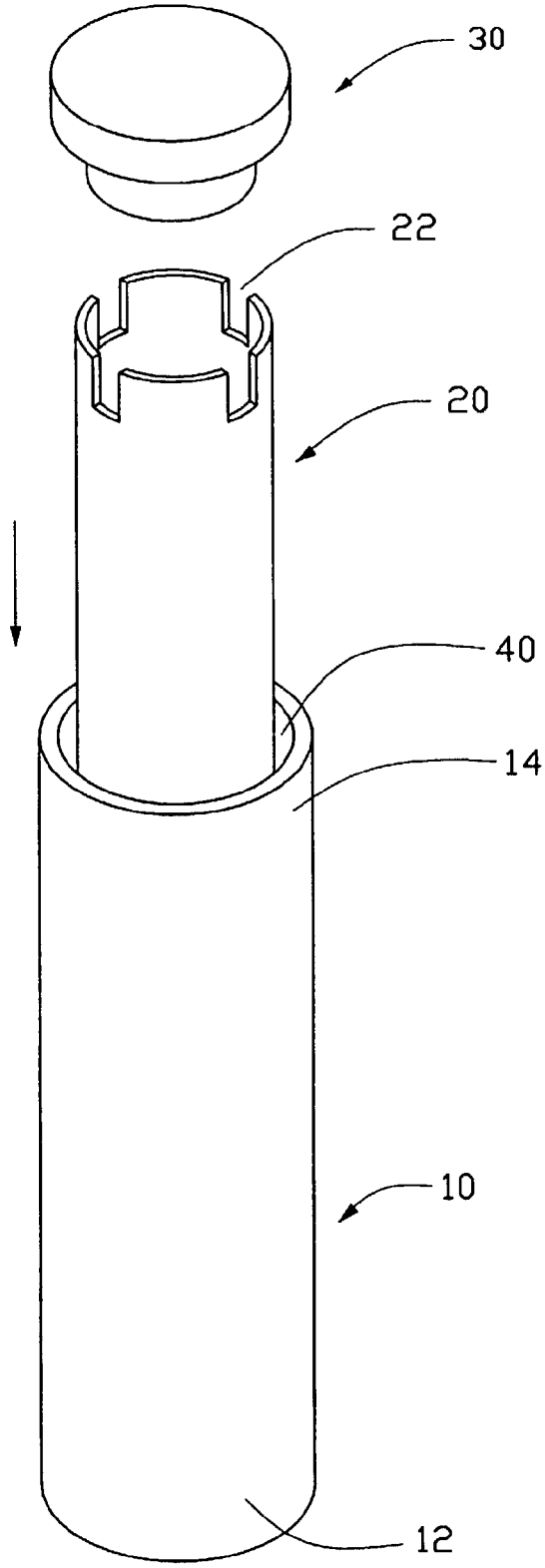
FIG. 2 is an enlarged view of FIG. 1, and showing the inner pipe being inserted into the outer pipe.
Figure 3:
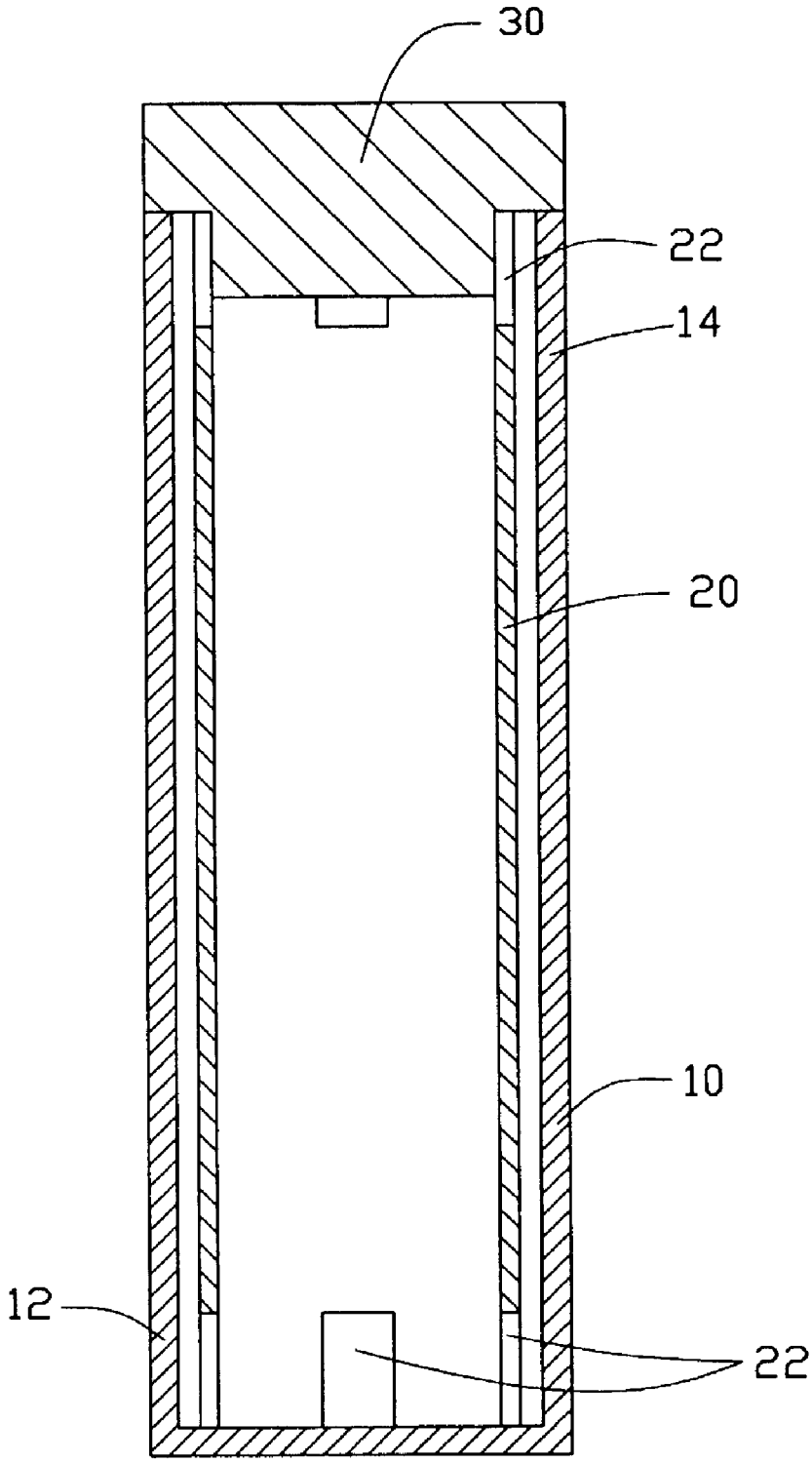
FIG. 3 is a cross-sectional view of the heat pipe of FIG. 1 fully assembled.

Referring also to FIGS. 2 and 3, in assembly, the inner pipe 20 is fixedly received in the outer pipe 10. A very narrow cylinder-shaped gap 40 is thereby defined between the outer pipe 10 and the inner pipe 20, to provide passage for condensed working fluid therebetween. Because the gap 40 is very narrow, surface tension of the working fluid and capillary action of the outer and inner pipes 10, 20 is enhanced. In addition, suitable granules can be put into the gap 40 to form a porous wicking structure, whereby capillary action is enhanced. The hermetic cap 30 is then plugged onto the condensing end 14 of the outer pipe 10, such that the cap 30 engages in the inner pipe 20. A hermetically sealed chamber is thereby formed within the outer pipe 10.

In operation, when the evaporating end 12 of the outer pipe 10 is heated by an external heat source (not shown), the working fluid is vaporized. The vapor flows upwardly inside the inner pipe 20 toward the condensing end 14 of the outer pipe 10 and away from the heat source, and condenses back to liquid working fluid at the condensing end 14. The condensed working fluid passes through the cutouts 22 at the condensing end 14 and enters the gap 40. The very narrow gap 40, whether having the described porous wicking structure or not, causes the condensed working fluid to rapidly flow back down to the evaporating end 12. At the evaporating end 12, the condensed working fluid enters the inner pipe 20 through the cutouts 22.

As described above, the gap 40 provides passage for the condensed working fluid. Because the gap 40 is very narrow, it effectively prevents vapor from flowing upwardly therein. Thus the gap 40 circumvents the risk of upwardly flowing vapor interfering with downwardly flowing condensed working fluid.

Figure 4:
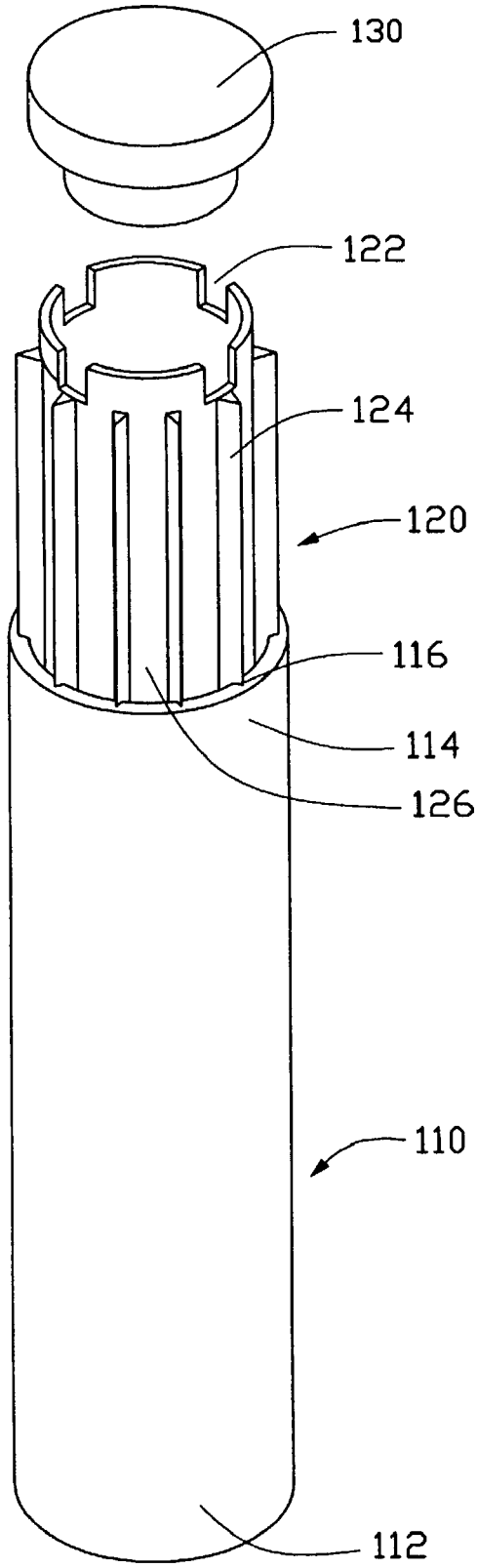
FIG. 4 is a partly assembled perspective view of a heat pipe in accordance with an alternative embodiment of the present invention.

FIG. 4 shows a heat pipe in accordance with an alternative embodiment of the present invention. The heat pipe comprises an outer pipe 110, an inner pipe 120, and a hermetic cap 130. The outer pipe 110 comprises an evaporating end 112, and an opposite condensing end 114. Working fluid (not shown) is received in the evaporating end 112 of the outer pipe 110. A plurality of evenly spaced and parallel longitudinal grooves 116 is defined in an inner surface of the outer pipe 110. The inner pipe 120 comprises an open top and an open bottom. A plurality of evenly spaced cutouts 122 is defined in each of top and bottom ends of the inner pipe 120. A plurality of evenly spaced and parallel longitudinal ribs 124 is formed on an outer surface of the inner pipe 120. Each rib 124 is partly received in a corresponding groove 116, and presses the outer pipe 110 to reinforce the heat pipe structure. Each two adjacent ribs 124 together with an outer surface of the inner pipe 120 and an inner surface of the outer pipe 110 cooperatively define a vertical capillary gap 126 therebetween, to enhance the capillary action of the heat pipe.

Figure 5:
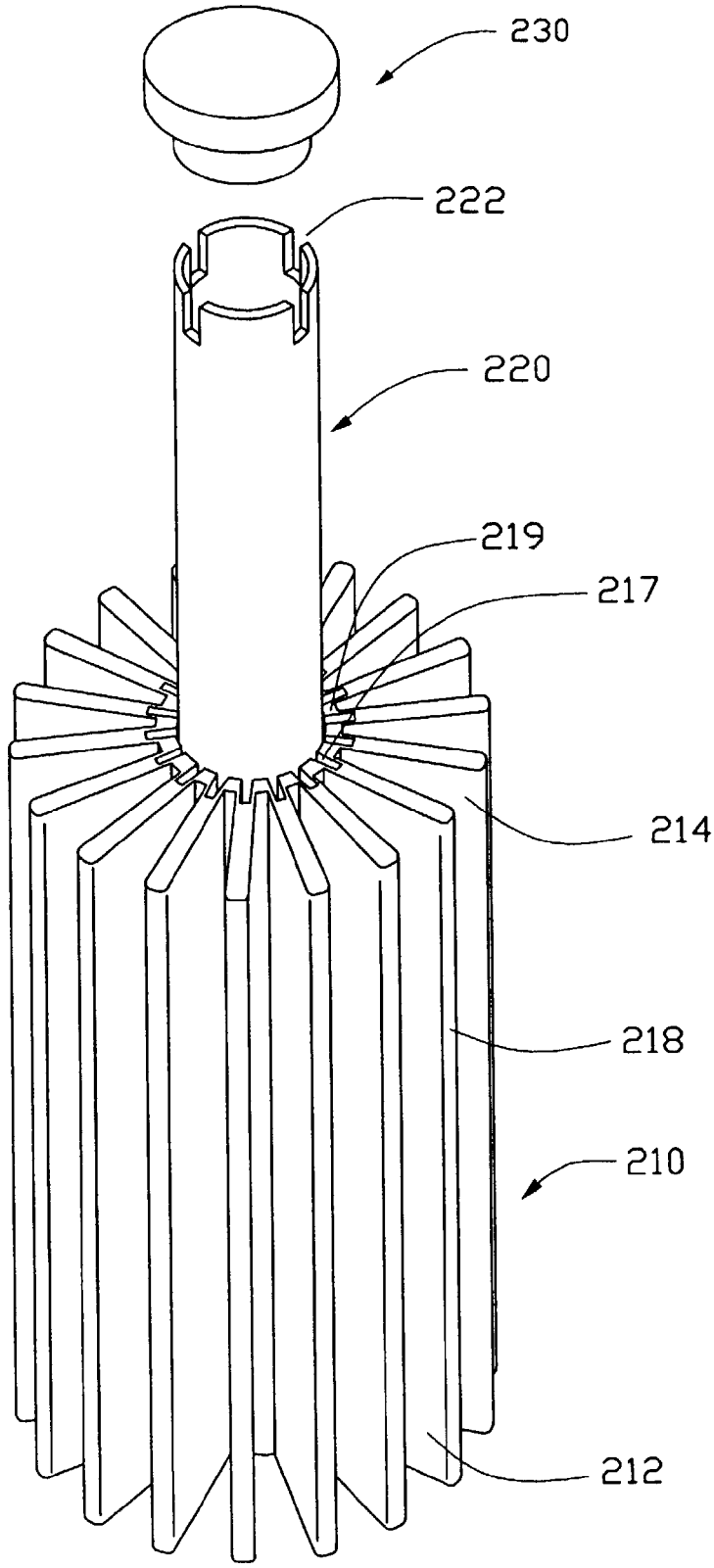
FIG. 5 is a partly assembled perspective view of a heat pipe in accordance with a further alternative embodiment of the present invention.

FIG. 5 shows a heat pipe in accordance with a further alternative embodiment of the present invention. The heat pipe comprises an outer pipe 210, an inner pipe 220, and a hermetic cap 230. The outer pipe has an evaporating end 212, and an opposite condensing end 214. Working fluid (not shown) is received in the evaporating end 212 of the outer pipe 210. The inner pipe 220 comprises an open top and an open bottom. A plurality of cutouts 222 is defined in each of top and bottom ends of the inner pipe 220. The outer pipe 210 comprises a plurality of evenly spaced and parallel longitudinal protrusions 219 at an inner periphery thereof. Each two adjacent protrusions 219 together with an inner surface of the outer pipe 210 and an outer surface of the inner pipe 220 cooperatively define a vertical capillary gap 217 therebetween, to enhance the capillary action of the heat pipe. The outer pipe 210 further comprises a plurality of evenly spaced and parallel longitudinal radiating fins 218 at an outer periphery thereof, for increasing a heat dissipating area of the heat pipe.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A heat pipe comprising:

an outer pipe receiving working fluid;

an inner pipe fixedly received in the outer pipe, at least one cutout being defined in each of opposite ends of the inner pipe for allowing the working fluid to pass between the inner pipe and the outer pipe; and a gap defined between the outer pipe and the inner pipe, wherein the gap is very narrow such that an inner wall of the outer pipe and an outer wall of the inner pipe cooperatively form a wicking structure;

wherein the inner pipe has a height approximately equal to a height of the outer pipe and wherein the working fluid passes between the inner pipe and the outer pipe only through the at least one cutout defined in each of opposite ends of the inner pipe.

2. The heat pipe as described in claim 1, further comprising a cap attached to an end of the outer pipe thereby sealing the outer pipe.

3. The heat pipe as described in claim 2, wherein the outer pipe has an evaporating end and an opposite condensing end, and the cap is attached to the condensing end.

4. The heat pipe as described in claim 2, wherein one of the opposite ends of the inner pipe is attached to a corresponding end of the outer pipe, and the other of the opposite ends of the inner pipe is engaged with the cap.

5. The heat pipe as described in claim 2, wherein the other end of the outer pipe is integrally sealed.

6. The heat pipe as described in claim 1, wherein granules are received in the gap thereby forming a porous wicking structure.

7. The heat pipe as described in claim 5, wherein a plurality of grooves is defined in the inner wall of the outer pipe, a plurality of ribs is arranged on the outer wall of the inner pipe, and each of the ribs is partly and pressingly received in a corresponding groove whereby a plurality of capillary gaps is defined between the outer pipe and the inner pipe.

8. The heat pipe as described in claim 5, wherein a plurality of protrusions is arranged on the inner wall of the outer pipe, whereby a plurality of capillary gaps is defined between the outer pipe and the inner pipe.

9. The heat pipe as described in claim 1, wherein a plurality of fins is arranged on an outer surface of the outer pipe.

10. A heat pipe for dissipating heat from a heat-generating electronic device, the heat pipe comprising:

an outer pipe comprising an evaporating end and a condensing end, one of the evaporating end and the condensing end being integrally sealed;

an inner pipe received in the outer pipe and having a height approximately equal to a height of the outer pipe, the inner pipe and the outer pipe being in communication with each other respectively at the evaporating and condensing ends only, wherein the inner pipe and the outer pipe cooperatively form a wicking structure therebetween; and working fluid received in the evaporating end of the outer pipe and a corresponding end of the inner pipe, wherein when the evaporating end of the outer pipe is heated, the working fluid evaporates, flows inside the inner pipe to the condensing end, condenses at the condensing end, and flows back to the evaporating end through the wicking structure.

11. The heat pipe as described in claim 10, wherein the evaporating end is integrally sealed, and the condensing end is sealed with a cap.

12. The heat pipe as described in claim 10, wherein at least one cutout is defined in each of opposite ends of the inner pipe, for allowing the working fluid to pass between the inner pipe and the wicking structure.

13. The heat pipe as described in claim 10, wherein a very small gap is defined between the inner pipe and the outer pipe, the gap together with an outer wall of the inner pipe and an inner wall of the outer pipe cooperatively forming the wicking structure.

14. The heat pipe as described in claim 13, wherein a plurality of granules is received in the gap thereby forming a porous wicking structure.

15. The heat pipe as described in claim 13, wherein a plurality of grooves is defined in an inner surface of the outer pipe, a plurality of ribs is arranged on an outer surface of the inner pipe, and each of the ribs is partly and pressingly received in a corresponding groove whereby a plurality of capillary gaps is defined between the outer pipe and the inner pipe.

16. The heat pipe as described in claim 13, wherein the outer pipe further comprises a plurality of protrusions at an inner periphery thereof, whereby a plurality of capillary gaps is defined between the outer pipe and the inner pipe.

17. The heat pipe as described in claim 10, wherein the outer pipe further comprises a plurality of fins arranged at an outer periphery thereof.

18. A method of heat transfer, comprising steps of:

providing an outer pipe;

providing an inner pipe in said outer pipe, the inner pipe having a height approximately equal to a height of the outer pipe;

forming passageways only around opposite evaporating and condensing ends of said inner pipe to have an interior of said inner pipe communicating with a space between said outer pipe and said inner pipe through the passageways only around opposite evaporating and condensing ends of said inner pipe; and having working fluid move in both said interior and said space in circulation;

configuring the space with a capillary function; wherein in said circulation, the vaporized working fluid at the evaporating end moves upwardly in said interior and is condensed at the condensing end to release heat thereof and further enter the space via the passageway and move downwardly rapidly, with assistance of the capillary function provided thereof, toward the evaporating end for absorbing heat and entering the interior again, wherein the outer pipe is integrally sealed in one of the evaporating and condensing ends.

* * * * *